US005916340A

United States Patent [19]

Forsyth

[11] Patent Number: 5,916,340

[45] Date of Patent: Jun. 29, 1999

[54] MAGNETIC SOCKET WRENCH CONNECTOR TIP

[76] Inventor: Don Forsyth, 4 7th St., Petaluma, Calif. 94952

[21] Appl. No.: 09/004,424

[22] Filed: Jan. 8, 1998

[51] Int. Cl.[6] ..... B25B 13/02; B25B 13/00

[52] U.S. Cl. ..... 81/125; 81/124.6

[58] Field of Search ..... 81/125, 124.6, 81/177.2, 177.85, 900

[56] References Cited

U.S. PATENT DOCUMENTS

| | | | |
|---|---|---|---|
| 4,219,063 | 8/1980 | Berkman | 145/52 |
| 4,744,273 | 5/1988 | Bartok, Jr. | 81/453 |
| 4,898,053 | 2/1990 | Russo | 81/125 |
| 5,249,489 | 10/1993 | Weisman | 81/125 |
| 5,542,320 | 8/1996 | Vasichek et al. | 81/125 |

*Primary Examiner*—Timothy V. Eley
*Assistant Examiner*—Philip J. Hoffmann
*Attorney, Agent, or Firm*—Jack Lo

[57] ABSTRACT

A magnetic socket wrench connector tip comprises a male connector tip for inserting into the female end of a socket. A magnet is partially embedded in the front face of the tip. The magnet projects far enough from the front face so that, when the tip is attached to a socket and a fastener is positioned in the socket, the magnet is in contact with the fastener to retain it within the socket. In a second embodiment, the tip is longer than a standard tip to enclose the magnet, which is seated flush with the front face of the tip. In a third embodiment, a tube is attached to the front face of the tip. A magnet is slidably positioned within the tube, and partially projecting from its front end. A spring is positioned within the tube and behind the magnet for absorbing shock when a fastener is pushed against the magnet. The magnetic socket wrench connector tip may be provided on any socket wrench tool with a connector tip, including ratcheting handles and extension bars.

8 Claims, 1 Drawing Sheet

MAGNETIC SOCKET WRENCH CONNECTOR TIP

BACKGROUND OF THE INVENTION

1. Field Of The Invention

This invention relates generally to devices for retaining fasteners on a tool, such as a socket wrench or screwdriver.

2. Prior Art

Sometimes a bolt or nut must be installed in a recessed area too deep or small for a user to reach in to hold the nut by hand and positioned it against a hole. U.S. Pat. No. 4,744,273 to Bartok, Jr. shows a U-shaped clip positioned around a socket. A bolt positioned in the socket is retained by inwardly bent tips of the clip. However, the bolt must be pushed into the socket with extra force to spread the clips, which is inconvenient. Further, the clip only fits a socket of a particular width and length, so that different clips must be made for different sockets. U.S. Pat. No. 4,219,063 to Berkman shows a magnetic device for retaining a screw at the tip of a screwdriver. It includes a magnet attached to the shank of the screwdriver. The bent tips of two prongs extending from the magnet hold and align the screw against the tip. However, it is large and cumbersome. It is offset from the axle of the handle, so that it is unbalanced when the tool is turned. Further, the screw must be carefully positioned between the prongs and the screwdriver tip.

OBJECTS OF THE INVENTION

Accordingly, objects of the present magnetic socket wrench connector tip are:

to retain a fastener, such as a nut or bolt, within a socket;

to retain the fastener within the socket without any additional effort or step in the normal use of the socket; and to be usable with different sockets without adding cost to them.

Further objects of the present invention will become apparent from a consideration of the drawings and ensuing description.

BRIEF SUMMARY OF THE INVENTION

A magnetic socket wrench connector tip comprises a male connector tip for inserting into the female end of a socket. A magnet is partially embedded in the front face of the tip. The magnet projects far enough from the front face so that, when the tip is attached to a socket and a fastener is positioned in the socket, the magnet is in contact with the fastener to retain it within the socket. In a second embodiment, the tip is longer than a standard tip to enclose the magnet, which is seated flush within the front face of the tip. In a third embodiment, a tube is attached to the front face of the tip. A magnet is slidably positioned within the tube, and partially projecting from its front end. A spring is positioned within the tube and behind the magnet for absorbing shock when a fastener is pushed against the magnet. The magnetic socket wrench connector tip may be provided on any socket wrench tool with a connector tip, including ratcheting handles and extension bars.

DRAWING REFERENCE NUMERALS

| |
|---|
| 10. Connector Tip |
| 11. Female End |
| 12. Socket |
| 13. Extension |
| 14. Front Face |
| 15. Head |
| 16. Bolt |
| 17. Magnet |
| 18. Cavity |
| 19. Retainer Ball |
| 20. Connector Tip |
| 21. Magnet |
| 22. Front Face |
| 23. Connector Tip |
| 24. Tube |
| 25. Front Face |
| 26. Magnet |
| 27. Spring |

DETAILED DESCRIPTION OF THE INVENTION

FIG. 1

Figure 1:
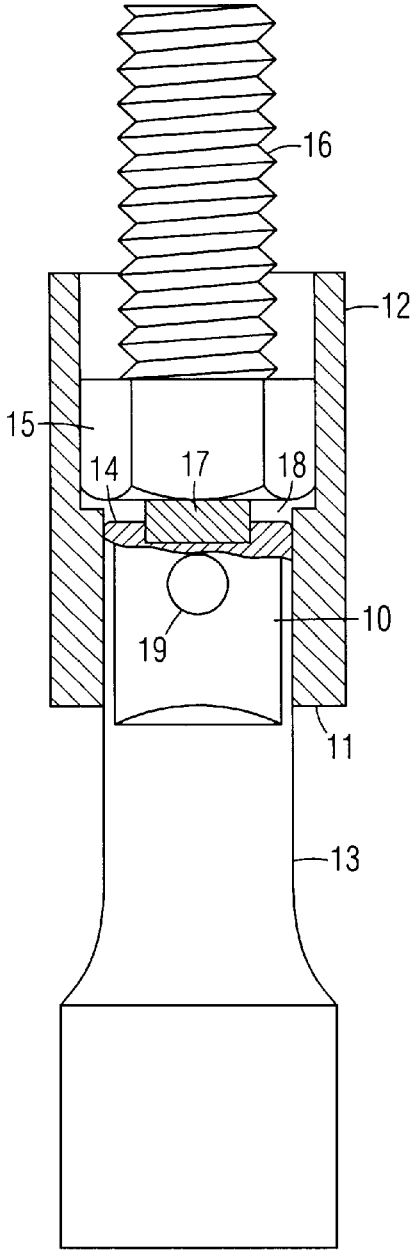
FIG. 1 is a partial cutaway side view of a first embodiment of a magnetic socket wrench connector tip.

A first embodiment of a magnetic socket wrench connector tip 10 is shown in a partial cutaway side view in FIG. 1. It has a rectangular cross section for inserting into a rectangular hole in a female end 11 of a conventional socket 12. In this example, tip 10 comprises the male end of a socket wrench extension 13, but it can be the male end of any socket wrench related device for being inserted into the female end of a socket, including ratcheting handles, universal joints, etc. Tip 10 preferably has industry standard dimensions, so that it can fit into any conventional socket. Because tip 10 has a standard length, its front face 14 is spaced away from a head 15 of a bolt 16 when the bolt is fully seated within socket 12.

A magnet 17 is fixedly attached to front face 14 of tip 10, and projects far enough therefrom so that it extends slightly into a fastener receiving cavity 18 of socket 12 and abuts head 15 of bolt 16. Magnet 17 is partially embedded in tip 10 for added security, but does not extend into tip 10 far enough to interfere with a conventional spring-loaded retainer ball 19. Magnet 17 is preferably a high strength magnet, such as neodymium-iron-boron.

When bolt 16 is inserted into socket 12 in a conventional manner, it is automatically retained by magnet 17. No additional force or step is required during insertion. Bolt 16 can thus be positioned against a hole in a confined area without being held by a hand. Connector tip 10 can be used with any socket, so that it is much less expensive than providing a magnet on each socket.

FIG. 2

Figure 2:
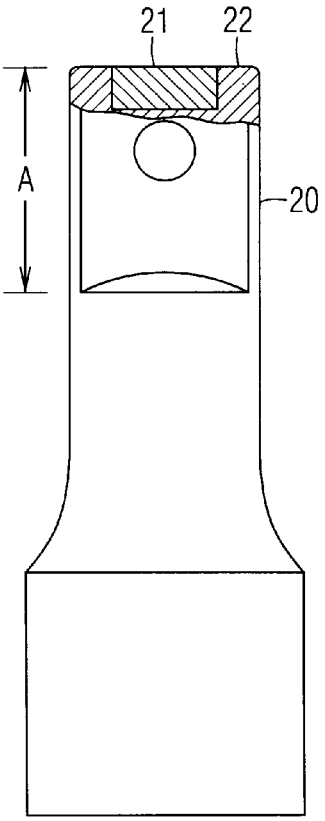
FIG. 2 is a partial cutaway side view of a second embodiment of the magnetic socket wrench connector tip.

A second embodiment of a magnetic socket wrench connector tip 20 is shown in a partial cutaway side view in FIG. 2. It has a length A which is slightly greater than the industry standard, so that a magnet 21 embedded therein is flush with its front face 22 and protected from damage.

Figure 3:
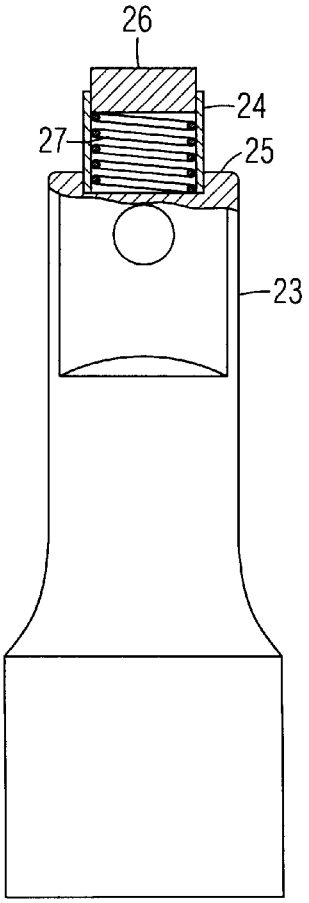
FIG. 3 is a partial cutaway side view of a third embodiment of the magnetic socket wrench connector tip.

FIG. 3:

A third embodiment of a magnetic socket wrench connector tip 23 is shown in a partial cutaway side view in FIG. 3. It includes a tube 24 partially embedded in a front face 25. A magnet 26 is positioned in a front end of tube 24, and is movable longitudinally therein. A spring 27 is positioned within tube 24 behind magnet 26 for absorbing shock when a fastener is pushed against magnet 26.

SUMMARY AND SCOPE

Accordingly, a magnetic socket wrench connector tip is provided herein. It retains a fastener within a socket, so that the fastener can be positioned in a confined area where a user cannot reach in to hold it by hand. It retains the fastener within the socket without any additional effort or step in the normal use of the socket. It is also usable with different sockets without adding cost to them.

Although the above description is specific, it should not be considered as a limitation on the scope of the invention, but only as an example of the preferred embodiment. Many substitutes and variations are possible within the teachings of the invention. For example, the magnetic socket wrench connector tip can be used for retaining a nut in a socket. Any suitable type of magnet can be used. The magnet can be of different shapes and sizes. A protective steel plate can be positioned against the front of the magnet, so that the magnet is completely embedded within the connector tip. Pole pieces can be provided for the magnet for maximizing the pull on the fastener. The magnet can be mounted on the front face of the connector tip without being recessed. Therefore, the scope of the invention should be determined by the appended claims and their legal equivalents, not by the examples given.

I claim:

1. A magnetic socket wrench connector tip, comprising:

a male connector tip for being inserted into a female end of a socket;

a spring-loaded retainer ball positioned in said male connector tip and spaced away from a front face thereof; and a magnet attached to said front face of said male connector tip for retaining a fastener positioned in said socket, said magnet extending into said front face of said male connector tip but terminating short of said spring-loaded retainer ball.

2. The magnetic socket wrench connector tip of claim 1, wherein said magnet is arranged for extending into a fastener receiving cavity of said socket and making contact with said fastener.

3. The magnetic socket wrench connector tip of claim 1, wherein said magnet is embedded flush within said front face of said male connector tip for protection from damage.

4. The magnetic socket wrench connector tip of claim 1, wherein said male connector tip has a rectangular cross section for inserting into a rectangular hole in said female end of said socket.

5. A magnetic socket wrench connector tip, comprising:

a male connector tip having a rectangular cross section for inserting into a rectangular hole in a female end of a socket;

a spring-loaded retainer ball positioned in said male connector tip and spaced away from a front face thereof; and a magnet attached to said front face of said male connector tip for extending into a fastener receiving cavity of said socket, said magnet is arranged for making contact with a fastener positioned in said fastener receiving cavity and retaining said fastener, said magnet extending into said front face of said male connector tip but terminating short of said spring-loaded retainer ball.

6. A magnetic socket wrench connector tip, comprising:

a male connector tip for being inserted into a female end of a socket;

a spring-loaded retainer ball positioned in said male connector tip and spaced away from a front face thereof;

a tube attached to said front face of said male connector tip and coaxial therewith, said tube extending into said front face of said male connector tip but terminating short of said spring-loaded retainer ball;

a magnet slidably positioned within a front end of said tube and partially extending therefrom, said magnet for retaining a fastener positioned in said socket; and a spring positioned within said tube behind said magnet for absorbing shock when said fastener is positioned against said magnet.

7. The magnetic socket wrench connector tip of claim 6, wherein said tube is partially recessed into said front face of said male connector tip for added strength.

8. The magnetic socket wrench connector tip of claim 6, wherein said male connector tip has a rectangular cross section for inserting into a rectangular hole in said female end of said socket.

* * * * *